United States Patent [19]

Krasser

[11] 4,314,217

[45] Feb. 2, 1982

[54] LOCKING DEVICE

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 63,114

[22] Filed: Aug. 1, 1979

[30] Foreign Application Priority Data

Aug. 2, 1978 [DE] Fed. Rep. of Germany ..... 2833860

[51] Int. Cl.[3] ..... H01H 3/42

[52] U.S. Cl. ..... 335/188; 70/280; 335/168; 335/190

[58] Field of Search ..... 335/171, 188, 190, 191, 335/167, 168; 70/280

[56] References Cited

U.S. PATENT DOCUMENTS

| | | | |
|---|---|---|---|
| 2,830,149 | 4/1958 | Winans | 335/188 |
| 3,728,651 | 4/1973 | Foster | 335/190 X |
| 3,893,723 | 7/1975 | Boule | 70/280 X |
| 4,003,010 | 1/1977 | Kuchuris et al. | 335/188 X |
| 4,142,167 | 2/1979 | Little et al. | 335/190 |

FOREIGN PATENT DOCUMENTS 2258812 6/1974 Fed. Rep. of Germany .

*Primary Examiner*—Robert J. Hickey
*Attorney, Agent, or Firm*—Spencer & Kaye

[57] ABSTRACT

A locking device includes a housing, a plunger slidably supported in the housing for displacement in a first direction between two end positions and an electromagnet disposed in the housing and having a solenoid and an armature displaceable in a second direction by the force of a magnetic field generated upon energization of the solenoid and a coupling arrangement for operatively connecting the armature with the plunger for affecting the position of the plunger dependent upon the position of the armature. The coupling arrangement comprises a switch-over device which has two stable end positions and which is force-transmittingly connected to the plunger.

17 Claims, 6 Drawing Figures

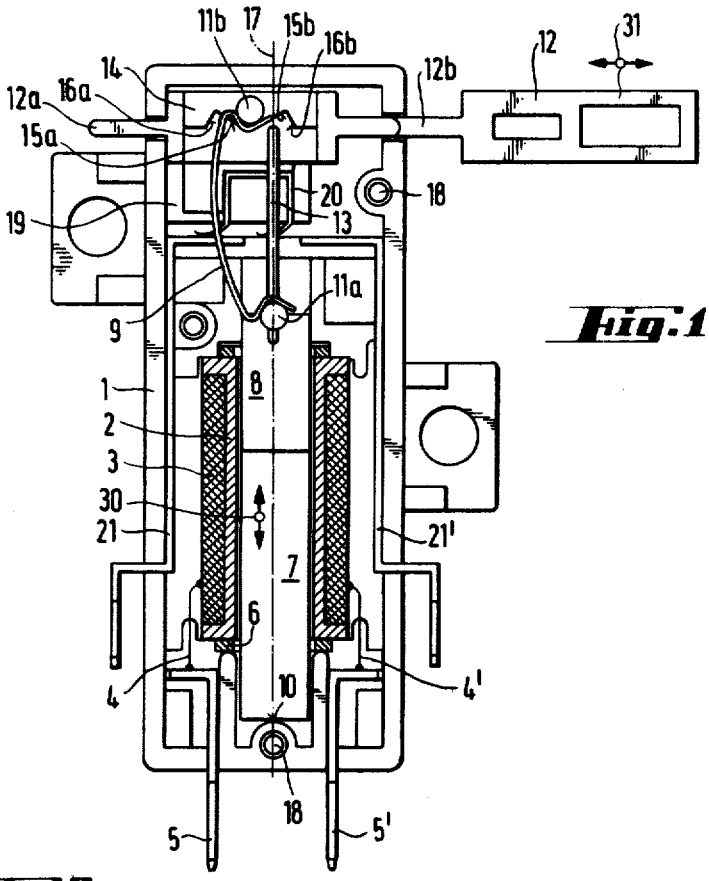
Fig. 1
Fig. 2
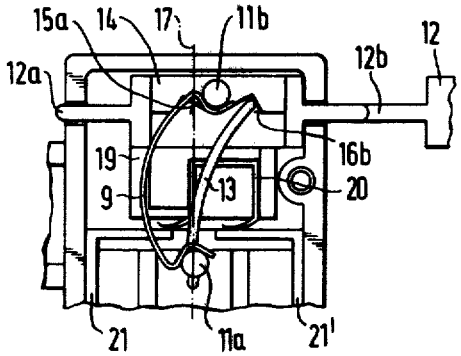
Fig. 3
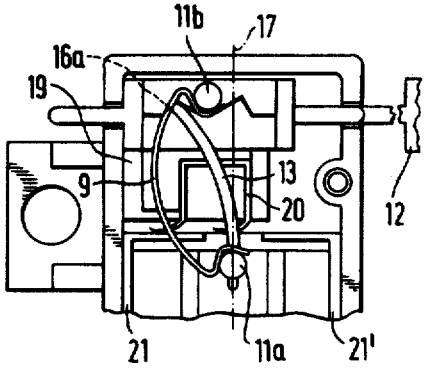

LOCKING DEVICE

BACKGROUND OF THE INVENTION

The invention relates to a locking device, particularly for washing machine doors and includes a plunger accommodated in a housing and displaceable between two end positions and an electromagnet affecting the position of the plunger.

Electrically operated locking devices, which are used particularly in washing machine doors, are known, for example from German Laid-Open Application (Offenlegungsschrift) No. 2,258,812. The known locking devices have a housing to accommodate the electrical and mechanical switching components as well as a plunger which is usually displaceable transversely to the longitudinal direction of the housing and which constitutes the actual locking member. In most of the known locking devices, the plunger is displaced with the aid of bimetal strips. Additionally, in the device according to German Laid-Open Application No. 2,258,812, an electromagnet is provided which, when excited, rapidly displaces the plunger into the locked position. The mechanical arrest (locking) in this position is effected by an angle lever which during the displacement of the plunger is carried along by the force of a torsion spring. To the angle lever there is fastened a pin which, when the end position of the plunger has been reached, engages and locks behind a holding tongue. The plunger is pushed back into the unlocked position with the aid of a bimetal strip whose bending movement pushes back the above-mentioned holding tongue and thus unlocks the rotary lever together with the pin.

More recent models of washing machines employ semi-electronic or even fully electronic control circuits which operate, for example, with the aid of microprocessors. In circuits of this type also the locking device for the washing machine door receives the commands for locking and unlocking exclusively in the form of pulses.

SUMMARY OF THE INVENTION

It is therefore an object of the invention to provide an improved locking device, particularly for washing machine doors, wherein the locking device is controllable exclusively by pulses, so that after each pulse the plunger is displaced alternatingly into a stable locked position or into a stable unlocked position.

This object and others to become apparent as the specification progresses, are accomplished by the invention, according to which, briefly stated, the armature of the electromagnet is coupled with the plunger in a positive force-transmitting manner by means of a switch-over device which has two stable end positions.

BRIEF DESCRIPTION OF THE DRAWING

FIG. 1 is a top plan view of a first preferred embodiment of a locking device in which the plunger is in the unlocked position;

FIG. 2 is a top plan view of one part of the first embodiment, showing the plunger at the moment of locking;

FIG. 3 is a view similar to FIG. 2, showing the plunger at the moment of unlocking;

DESCRIPTION OF THE PREFERRED EMBODIMENTS

Figure 4:
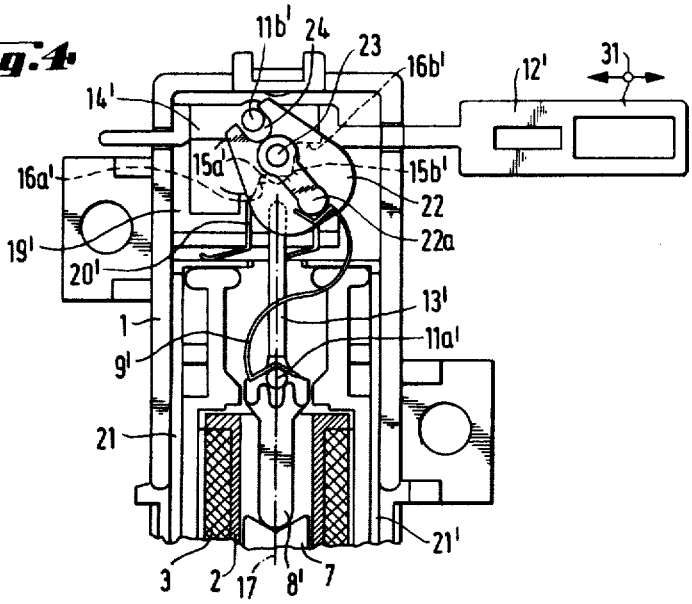
FIG. 4 is a fragmentary top plan view of a second preferred embodiment of the locking device in which the plunger is in the unlocked position.

FIG. 1 shows a housing shell 1 with all parts required for proper operation. The housing shell 1 is sealed, after installation, with a cover (not shown) which is placed onto pins formed on the housing shell and is thereafter fastened, for example, by hot compression of the pins or only by gluing.

The locking device further includes a plunger 12 which is connected, via a bearing rod **12*b*, with an extension 14 disposed in the interior of the housing shell 1. To provide a better support for the extension 14, the latter is provided with a further bearing rod 12*a*. The plunger 12, the bearing rods 12*a* and 12*b* as well as the extension 14 can be shifted back and forth in the direction of the double arrow 31. In order for this to be possible, the extension 14 must be shorter than the inner width of the housing shell 1**.

In the housing shell 1 there is further disposed an electromagnet which includes a core 2, a solenoid 3 supported thereon, a magnetic yoke 6 as well as an armature 7. The terminals 4 and 4' of the solenoid 3 are electrically connected with terminal pins 5 and 5'. The armature 7 is mounted in the interior of the core 2 to be displaceable in the direction of the double arrow 30.

Between the armature 7 of the electromagnet and the plunger 12 there is disposed a mechanical switch-over device which, when the armature 7 is displaced, brings the plunger 12 together with the extension 14 into the respective one or other end position and holds it there in a stable manner. The switch-over device includes, in addition to the extension 14, a slide 8 with a shaped-on lug 13 as well as a compression spring 9 which is disposed between a pin **11*a* formed on the slide 8 and a pin 11*b* projecting from extension 14. On the extension 14 there is further formed an abutment face in the form of an inverted W which is oriented toward the slide 8 and arranged to be symmetrical with pin 11*b*. The abutment face includes two oblique faces 15*a* and 15*b* which are arranged to either side of the pin 11*b* and extend in opposite directions and two oblique faces 16*a* and 16*b* adjoining the respective faces 15*a*, 15*b*** in the direction toward the slide.

Further, the extension 14 has an arm 19 at or in which a contact bridge 20 is provided. With the contact bridge 20 there are associated two terminals 21 and 21' held in the housing 1. As can be seen in FIG. 1, in the unlocked position the signal current circuit is open while in the locked position of FIG. 2 it is closed. With the aid of this signal current circuit the mechanical locking or unlocking, respectively, can be indicated to the control by the respective position of the contacts. With the aid of this signal current circuit it is also possible to detect malfunctions in the locking device.

The locking device operates as follows: in FIG. 1 the plunger 12 and the extension 14 are shown in the "unlocked position" in which the extension 14 rests with its left frontal face against the corresponding wall of the housing shell 1. The extension 14 is held in this position by the compression spring 9, since the pin **11*b* of the extension 14 is offset slightly to the left with respect to the longitudinal axis 17 of the housing, while the pin 11*a*** which supports the other end of the compression spring 9, lies exactly on the longitudinal axis 17 of the housing.

Upon energization of the solenoid 3 a magnetic field is built up, towards which the armature 7 is attracted. As a result, the armature 7 pushes with its upper frontal face against the corresponding lower frontal face of the slide 8 and displaces it upwardly against the force of the compression spring 9. The lug 13, which is made of a nonbulging but elastic material is thus pushed against the oblique face 15*b*, is deflected there and abuts against the steeper oblique face 16*b*. It thus moves the extension 14 and thus the plunger 12 to the right until the right-hand frontal face of the extension 14 rests against the corresponding inner wall of the housing shell 1. This state is shown in FIG. 2. When the solenoid 3 is deenergized upon termination of the excitation pulse, the spring 9 presses the slide 8 and thus also the armature 7 downwardly until the armature 7 abuts against the lower abutment 10 (FIG. 1). Since the pin 11*b* has now been moved so far to the right, due to the displacement of extension 14, that it lies to the right of the longitudinal axis 17 of the housing 1, the spring 9 presses the extension 14 into the position shown in FIG. 2 in which the right-hand frontal face of the extension 14 contacts the corresponding inner wall of the housing. The plunger 12 and the extension 14 are then in a stable position.

This procedure is repeated in the reverse direction as soon as the electromagnet is again energized by pulses. This causes the armature 7 to be pulled back into the magnetic field and the slide 8 is pushed upwardly. The lug 13 now abuts on the oblique face 15*a*, is deflected by it and then abuts on the steeper oblique face 16*a*. This moves the extension 14 to the left until its left-hand frontal face contacts the associated inner wall of the housing. The compression spring 9 then snaps over and now again assumes its original position (FIG. 1). The moment of snapping over is shown in FIG. 3.

Advantageously the pin 11*a* of the slide 8 is disposed on the longitudinal axis 17 of the housing, which simultaneously is the axis of the slide 8. The pin 11*b* at the extension 14 must lie next to the longitudinal axis 17; the distance of the center point of pin 11*b* from the longitudinal axis 17 is preferably less than the path of displacement of the extension 14. Moreover, a so-called spring clip is advantageously used as the compression spring 9. Springs of this type are known in principle and, due to their simple structure, are particularly well suited for installation. Moreover, the slide 8 and the lug 13 may advantageously be made as a one-piece plastic. This then provides a compact assembly unit which can easily be inserted into the open housing shell.

Figure 5:
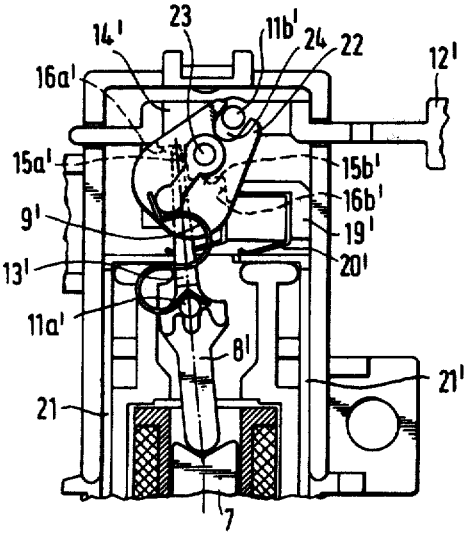
FIG. 5 is a view similar to FIG. 4, showing the plunger at the moment of locking.
Figure 6:
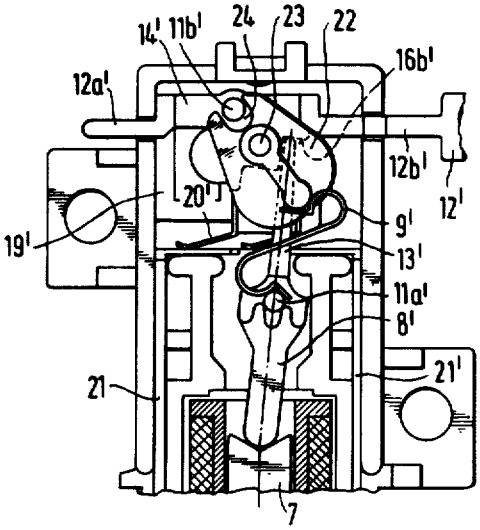
FIG. 6 is a view similar to FIG. 4, showing the plunger at the moment of unlocking.

Since it has been found in practice that the above-described embodiment will not always function properly, particularly when the locking device is subjected to shocks, a further improved embodiment of the locking device has been provided which will now be described in conjunction with FIGS. 4, 5 and 6. The same parts bear the same reference numerals and corresponding (functionally equivalent) parts bear the same reference numerals accompanied by a prime symbol. The main difference between the embodiment of FIGS. 1 through 3 and the embodiment of FIGS. 4 through 6 is that a switch-over member 22 mounted on a stationary bearing pin 23 in the housing shell 1 is disposed between the extension 14' and the slide 8'. On the side facing the extension 14, the switch-over member 22 is provided with a slot 24 with which the switch-over member 22 in part encloses, in a fork-line manner, the pin 11*b'* projecting from the extension 14'. On the underside of the switch-over member 22 there is formed an abutment face oriented toward slide 8' and having the shape of an inverted W. This abutment face is symmetrical to the bearing pin 23 and essentially includes the oblique faces 15*a'*, 15*b'*, 16*a'*, 16*b* '. Furthermore, a projection 22*a* is formed on the upper side of the switch-over member 22. An S-shaped compression spring 9' is inserted between the projection 22*a* and the pin 11*a'*. The shape of the slide 8' in FIGS. 4 to 6 has been changed somewhat compared to the shape of the slide 8 in FIGS. 1 to 3 so as to improve its mobility while the lowest possible force is applied.

The operation of the second embodiment is the same in principle as that of the first embodiment. When the solenoid 3 is energized and a magnetic field is built up, the armature 7 is pulled into the magnetic field and then abuts with its upper frontal face against the slide 8' and moves it upwardly against the force of the S-shaped compression spring 9'. This causes the lug 13' which is likewise made of a nonbulging but elastic material to be pushed against the oblique face 15*a'* to be deflected thereby and to abut on the steeper oblique face 16*a'*. As can be seen in FIG. 5, this causes the switch-over member to be pivoted clockwise thus carrying with it the pin 11*b'* of the extension 14' in the slot 24 so that the extension 14' and the plunger 12' connected therewith are shifted to the right. This state is shown in FIG. 6. When the solenoid 3 is de-energized, the spring 9' pushes the slide 8' and thus the armature 7 downwardly until it abuts on the abutment (not shown) at the lower end of the housing. The clockwise pivoting of the switch-over member 22 has moved the pin 11*b'* of the extension 14' so far to the right in FIG. 5 that it lies to the right of the longitudinal axis 17 of the housing and is held in this position by the spring 9' which causes the right-hand frontal face of the extension 14' to rest against the corresponding inner wall of the housing. The extension 14' and the plunger 12' are then in a stable position.

This procedure is repeated in the reverse direction similar to the first embodiment as soon as the electromagnet is again energized by pulses. The lug 13' now abuts against the oblique face 15*b'* and is deflected thereby and then abuts against the steeper oblique face 16*b'*. This causes the switch-over member 22 to be pivoted counterclockwise about the bearing pin 23 and carries with it the pin 11*b'* of the extension 14' to the left (FIG. 6) until the left-hand frontal face of extension 14' rests against the associated inner face of the housing. At this moment, the S-shaped compression spring 9' snaps over; this is depicted in FIG. 6. After the electromagnet is de-energized, the compression spring 9' and thus the locking device assume the unlocked position shown in FIG. 4.

In this embodiment as well, an arm 19' is provided on the extension 14' and the contact bridge 20' is accommodated thereon or therein, as the case may be. The contact bridge has associated terminals 21 and 21' as in the first embodiment so that the corresponding position of the locking device is indicated by the respective contact position of the signal bridge 20' with respect to the contact terminals 21 and 21'.

I claim:

1. In a locking device including a housing, a plunger slidably supported in the housing for displacement in a first direction between two end positions; an electromagnet disposed in the housing and having a solenoid and an armature displaceable in a second direction by the force of a magnetic field generated upon energization of the solenoid; and coupling means for operatively connecting the armature with the plunger for affecting the position of the plunger dependent upon the position of the armature; the improvement wherein said coupling means comprises a switch-over device having two stable end positions and being force-transmittingly connected to said plunger; said switch-over device comprising (a) a slide supported in said housing for displacement by said armature in said second direction;
(b) an extension connected with said plunger and supported in said housing for displacement in a third direction which is perpendicular to said second direction;
(c) a first pin affixed to said slide;
(d) a second pin affixed to said extension;
(e) a compression spring engaging said first and second pins in an over-the-center arrangement for maintaining said extension in position in either end position of said plunger;
(f) an abutment face of inverted W shape forming part of said extension and oriented towards said slide; and
(g) a resilient lug affixed to said slide and extending to said abutment face for engagement therewith to transmit a displacement force to said extension in said third direction upon movement of said slide toward said extension, whereby in either end position of said plunger the force of said compression spring is overcome and said extension, together with said plunger, is moved such that the plunger is displaced towards its other end position.

2. A locking device as defined in claim 1, wherein said slide and said armature have coinciding longitudinal axes and further wherein said slide and said armature are arranged end-to-end and have cooperating end faces.

3. A locking device as defined in claim 1, further wherein said extension has, at opposite ends, bearing rods supported in openings of said housing and further wherein one of said bearing rods connects said plunger to said extension.

4. A locking device as defined in claim 1, wherein said slide has a path of displacement having a central longitudinal axis; further wherein said first pin is in alignment with said axis and said second pin is situated laterally of said axis when said plunger is in one of its end positions; the distance between the center of said second pin and said axis is, when said plunger is in one of its end positions, smaller than the length of a displacement path of said extension.

5. A locking device as defined in claim 1, wherein said abutment face is arranged symmetrically with respect to said second pin.

6. A locking device as defined in claim 1, wherein said compression spring is a spring clip.

7. A locking device as defined in claim 1, wherein said slide and said resilient lug are a one-piece plastic member.

8. A locking device as defined in claim 1, further comprising (h) an arm affixed to and projecting from said extension;
(i) a contact bridge carried by said arm; and
(j) terminals supported in said housing and cooperating with said contact bridge.

9. In a locking device including a housing, a plunger slidably supported in the housing for displacement in a first direction between two end positions; an electromagnet disposed in the housing and having a solenoid and an armature displaceable in a second direction by the force of a magnetic field generated upon energization of the solenoid; and coupling means for operatively connecting the armature with the plunger for affecting the position of the plunger dependent upon the position of the armature; the improvement wherein said coupling means comprises a switch-over device having two stable end positions and being force-transmittingly connected to said plunger; said switch-over device comprising (a) a slide supported in said housing for displacement by said armature in said second direction;
(b) an extension connected with said plunger and supported in said housing for displacement in a third direction which is perpendicular to said second direction;
(c) a first pin affixed to said slide;
(d) a second pin affixed to said extension;
(e) a pivot pin arranged in said housing and affixed thereto;
(f) a switch-over member pivotally mounted on said pivot pin between said slide and said extension;
(g) means defining a slot in said switch-over member for receiving said second pin whereby said switch-over member is force-transmittingly connected to said extension;
(h) a compression spring engaging said first pin and said switch-over member in an over-the-center arrangement for maintaining said extension by said switch-over member in position in either end position of said plunger;
(i) an abutment face of inverted W shape forming part of said switch-over member and oriented towards said slide; and
(j) a resilient lug affixed to said slide and extending to said abutment face for engagement therewith to transmit a displacement force to said switch-over member upon movement of said slide toward said switch-over member, whereby in either end position of said plunger the force of said compression spring is overcome and said switch-over member, together with said extension and said plunger, is moved such that the plunger is displaced towards its other end position.

10. A locking device as defined in claim 9, wherein said compression spring has a generally S-shaped configuration.

11. A locking device as defined in claim 9, wherein said slide has a path of displacement having a central longitudinal axis; further wherein said first pin is in alignment with said axis and said second pin is situated laterally of said axis when said plunger is in one of its end positions; the distance between the center of said second pin and said axis is, when said plunger is in one of its end positions, smaller than the length of a displacement path of said extension.

12. A locking device as defined in claim 9, further comprising a projection forming part of said switch-over member, said compression spring engaging said projection.

13. A locking device as defined in claim 9, wherein said abutment face is arranged symmetrically with respect to said pivot pin.

14. A locking device as defined in claim 9, wherein said slide and said resilient lug are a one-piece plastic member.

15. A locking device as defined in claim 9, further wherein said extension has, at opposite ends, bearing rods supported in openings of said housing and further wherein one of said bearing rods connects said plunger to said extension.

16. A locking device as defined in claim 1, further comprising (k) an arm affixed to and projecting from said extension;

(l) a contact bridge carried by said arm; and (m) terminals supported in said housing and cooperating with said contact bridge.

17. A locking device as defined in claim 9, wherein said slide and said armature have coinciding longitudinal axes and further wherein said slide and said armature are arranged end-to-end and have cooperating end faces.

* * * * *